US006508086B2

(12) United States Patent
Chen

(10) Patent No.: US 6,508,086 B2
(45) Date of Patent: Jan. 21, 2003

(54) FLEXIBLE SHACKLE LOCK WITH A REPLACEABLE SHACKLE

(76) Inventor: Waterson Chen, 8F, No. 428, Wu-Chuan-Nan Rd., Taichung City (TW)

( * ) Notice: Subject to any disclaimer, the term of this patent is extended or adjusted under 35 U.S.C. 154(b) by 0 days.

(21) Appl. No.: 09/740,912

(22) Filed: Dec. 19, 2000

(65) Prior Publication Data

US 2002/0073747 A1 Jun. 20, 2002

(51) Int. Cl.[7] ..... E05B 67/06

(52) U.S. Cl. ..... 70/49; 70/18; 70/53; 70/54; 70/455

(58) Field of Search ..... 70/455, 423, 424, 70/427, 428, DIG. 43, DIG. 56, 49, 18, 58, 53, 54–56

(56) References Cited

U.S. PATENT DOCUMENTS 4,075,878 A * 2/1978 Best ..... 70/49
4,286,445 A * 9/1981 Sills ..... 70/55
4,297,861 A * 11/1981 Dykes ..... 70/55
5,447,043 A * 9/1995 Hwang ..... 70/49
5,752,416 A * 5/1998 Nien ..... 74/551.8
5,761,934 A * 6/1998 Kuo ..... 70/49
6,349,575 B1 * 5/2000 Bentley ..... 70/18
6,109,074 A * 8/2000 Du ..... 70/18
6,192,720 B1 * 2/2001 Kan ..... 70/49
6,341,509 B1 * 1/2002 McDaid ..... 70/39

FOREIGN PATENT DOCUMENTS

DE 3716370 A1 * 5/1987 ..... E05B/17/18

* cited by examiner

*Primary Examiner*—Robert J. Sandy
*Assistant Examiner*—Dinesh Melwani
(74) *Attorney, Agent, or Firm*—Ladas & Parry

(57) ABSTRACT

A shackle lock includes a lock casing, a lock core received in the lock casing, and a shackle unit which has first and second shackle connecting members extendible into first and second shackle holes in the lock casing and a flexible shackle portion connected to the shackle connecting members at two opposite ends. The first shackle connecting member engages the lock core when the lock core is operated to a locking state, and is disengaged from the lock core when the lock core is operated to an unlocking state, thereby permitting removal thereof from the lock casing. The second shackle connecting member is provided with a spring-loaded retaining member for engaging the lock casing. The retaining member is accessible with the use of a tool inserted into the first shackle hole after removal of the first shackle connecting member, and is adapted to be actuated by the tool for disengaging from the lock casing in order to permit removal of the second shackle connecting member from the lock casing.

8 Claims, 10 Drawing Sheets

FLEXIBLE SHACKLE LOCK WITH A REPLACEABLE SHACKLE

BACKGROUND OF THE INVENTION

1. Field of the Invention

The present invention relates to a flexible shackle lock, more particularly to a flexible shackle lock with a shackle unit which is detachable from a lock casing to permit replacement of the shackle unit.

2. Description of the Related Art

A flexible shackle lock generally includes an elongated flexible shackle member which extends through an article to be locked. The flexible shackle lock is commonly used for locking an article with a complicated configuration or for locking together a series of articles. FIGS. 1 and 2 illustrate a conventional shackle lock 10 of this type. The shackle lock 10 includes a lock body 11 provided with a combination lock unit 13 therein and having two opposite ends formed respectively with first and second shackle holes 111, 112. A flexible elongated shackle member 17 has opposite ends connected respectively with first and second shackle connecting members 171, 172 which are rigid. The first shackle connecting member 171 is fixed to the lock body 11 at the first shackle hole 111. The second shackle connecting member 172 is extendible into the second shackle hole 112, and is formed with an annular groove 173 for engaging a latch member 16 of the combination lock unit 13 when the combination lock unit 13 is in a locking state. When the lock unit 13 is operated to an unlocking state, the latch member 16 is disengaged from the annular groove 173 to permit removal of the second shackle connecting member 172 from the lock body 11. Since the first shackle connecting member 171 is secured to the lock body 11, and since the length of the shackle member 17 is fixed, the shackle lock 10 is useful within a limited range. It is desirable for the user that the shackle member 17 be replaceable with one having a different length. Moreover, since each shackle lock has a shackle member of a fixed length, a lock manufacturer usually has to produce various types of shackle locks with flexible shackle members of different lengths to suit different applications. This complicates the manufacture of the shackle lock and increases the manufacturing costs.

SUMMARY OF THE INVENTION

Therefore, the main object of the present invention is to provide a flexible shackle lock with a shackle unit which is detachable from a lock casing to permit replacement of the shackle unit.

Accordingly, the shackle lock of the present invention includes a lock casing, a lock core and a shackle unit. The lock casing has a lock core chamber, a lock core opening for access to the lock core chamber and aligned with the lock core chamber in a first direction, a first shackle chamber, a first shackle hole for access to the first shackle chamber and aligned with the first shackle chamber in a second direction parallel to the first direction, a second shackle chamber, a second shackle hole for access to the second shackle chamber and aligned with the second shackle chamber in a third direction transverse to the second direction, a first channel extending in a fourth direction transverse to the first and second directions for communicating the lock core chamber and the first shackle chamber, and a second channel extending in the second direction for communicating the first shackle chamber and the second shackle chamber. The lock core is received in the lock core chamber, and has a latch member. The lock core is operable for moving the latch member between a locking position in which the latch member extends through the first channel and projects into the first shackle chamber, and an unlocking position, in which the latch member is moved out of the first shackle chamber. The shackle unit includes first and second shackle connecting members and a flexible elongated shackle portion with two opposite ends connected respectively to the first and second shackle connecting members. The first shackle connecting member is extendible into the first shackle chamber via the first shackle hole, and is formed with a locking groove for engaging the latch member when the latch member is moved to the locking position. The second shackle connecting member is provided with a spring-loaded retaining member, and is extendible into the second shackle chamber via the second shackle hole to enable the retaining member to extend into the second channel for engaging the lock casing so as to retain the second shackle connecting member on the lock casing. The locking groove in the first shackle connecting member is disengaged from the latch member when the latch member is moved to the unlocking position, thereby permitting removal of the first shackle connecting member from the first shackle hole. The retaining member on the second shackle connecting member is accessible by means of a tool which is inserted into the first shackle hole when the first shackle connecting member is removed from the first shackle hole, and is adapted to be actuated by the tool for disengaging from the lock casing in order to permit removal of the second shackle connecting member from the lock casing via the second shackle hole.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
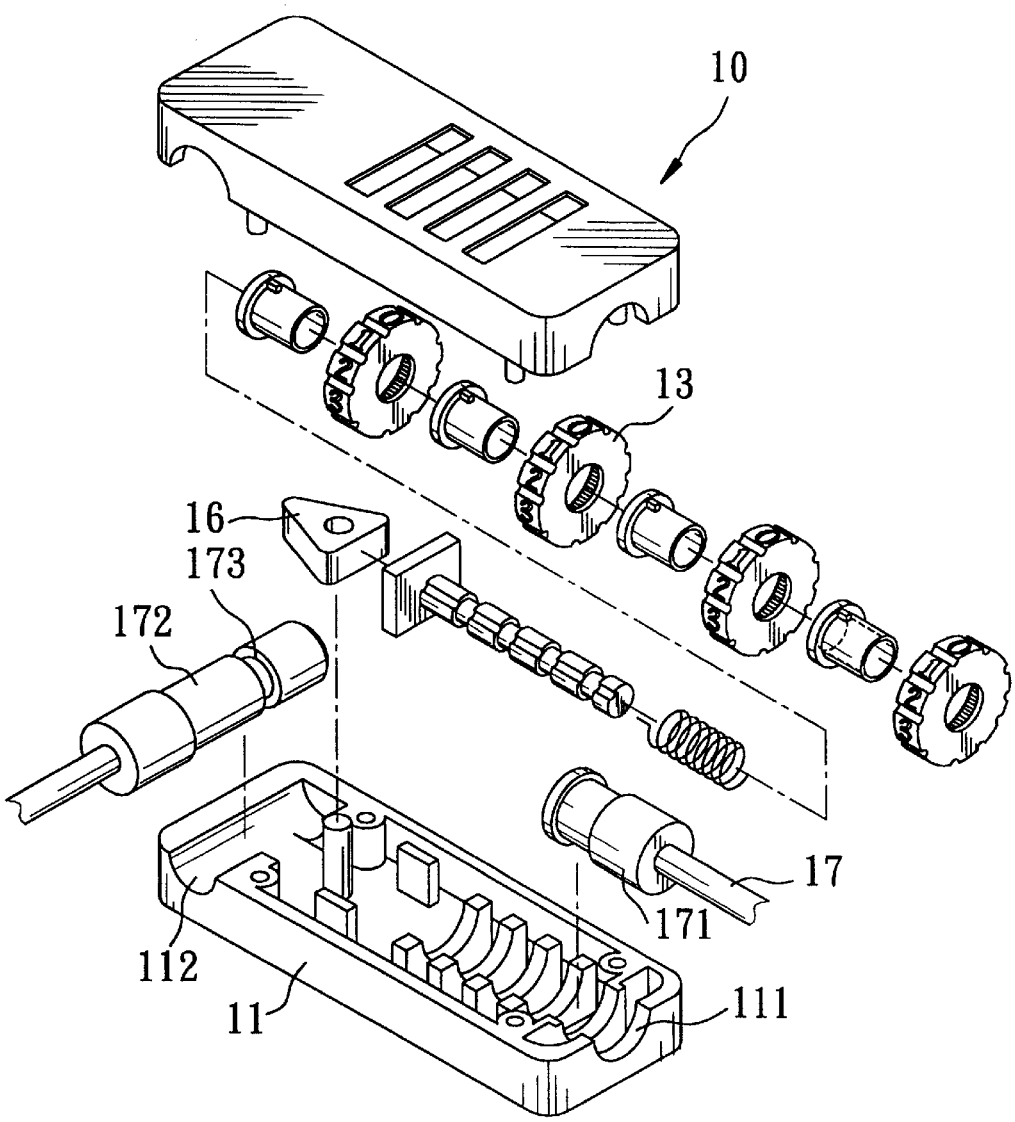
FIG. 1 PRIOR ART
FIG. 1 is a fragmentary exploded perspective view of a conventional shackle lock with a flexible elongated shackle member.
Figure 2:
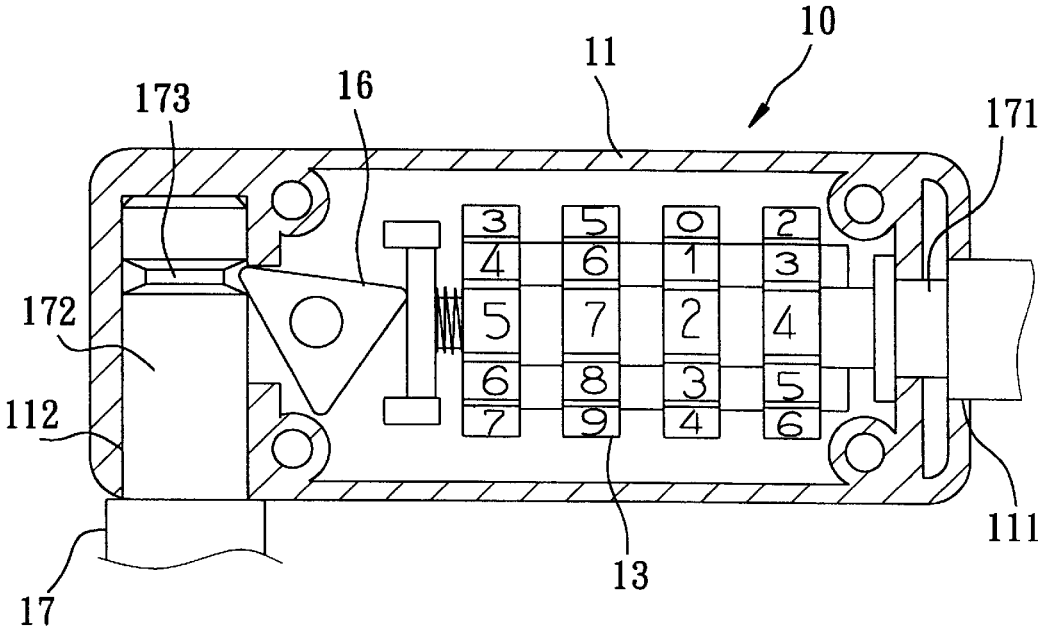
FIG. 2 PRIOR ART
FIG. 2 is a fragmentary sectional view of the conventional shackle lock.
Figure 3:
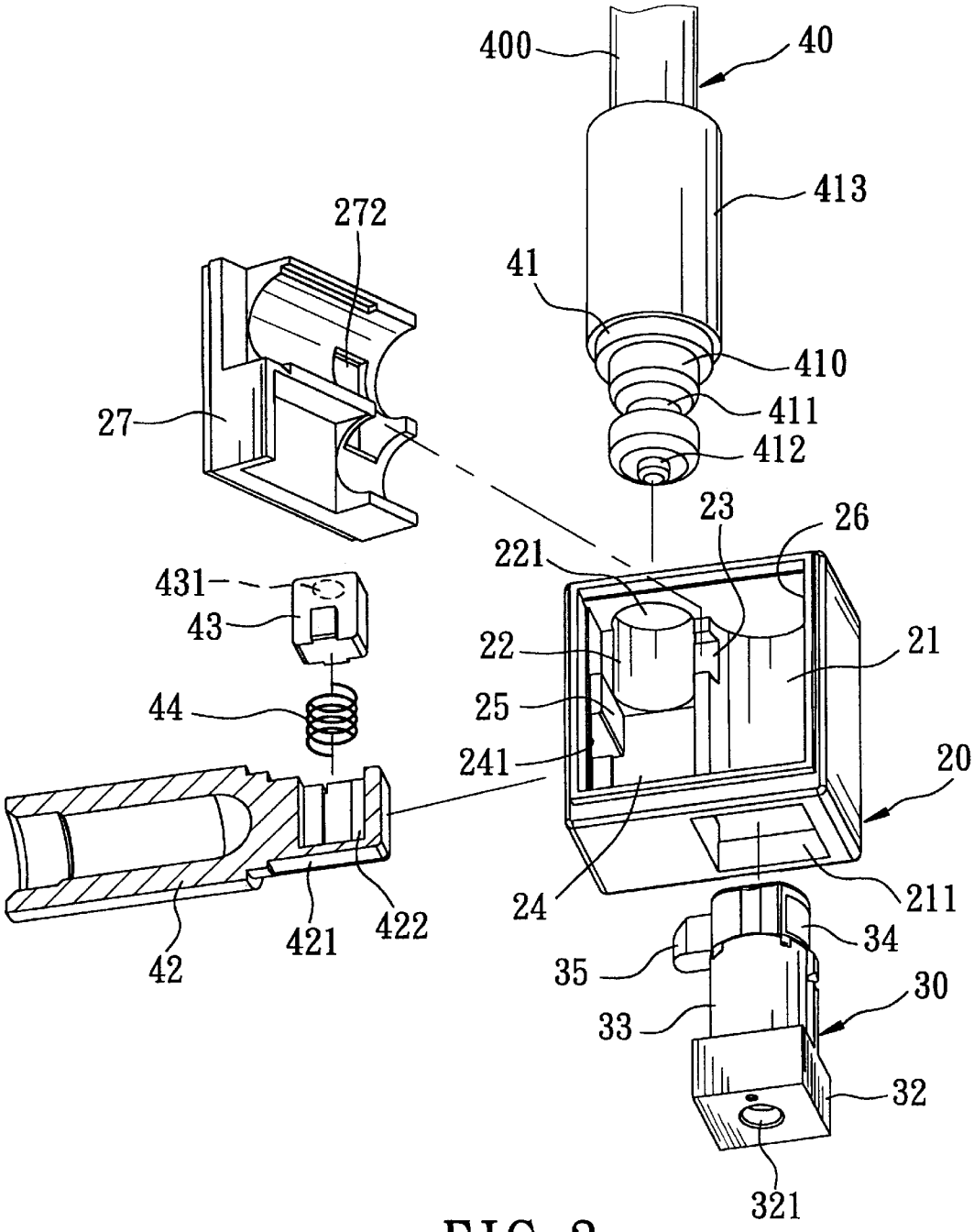
FIG. 3 is a partly sectioned, exploded perspective view of a preferred embodiment of the present invention, where a protective sleeve for protecting a lock casing is omitted for the sake of clarity.
Figure 4:
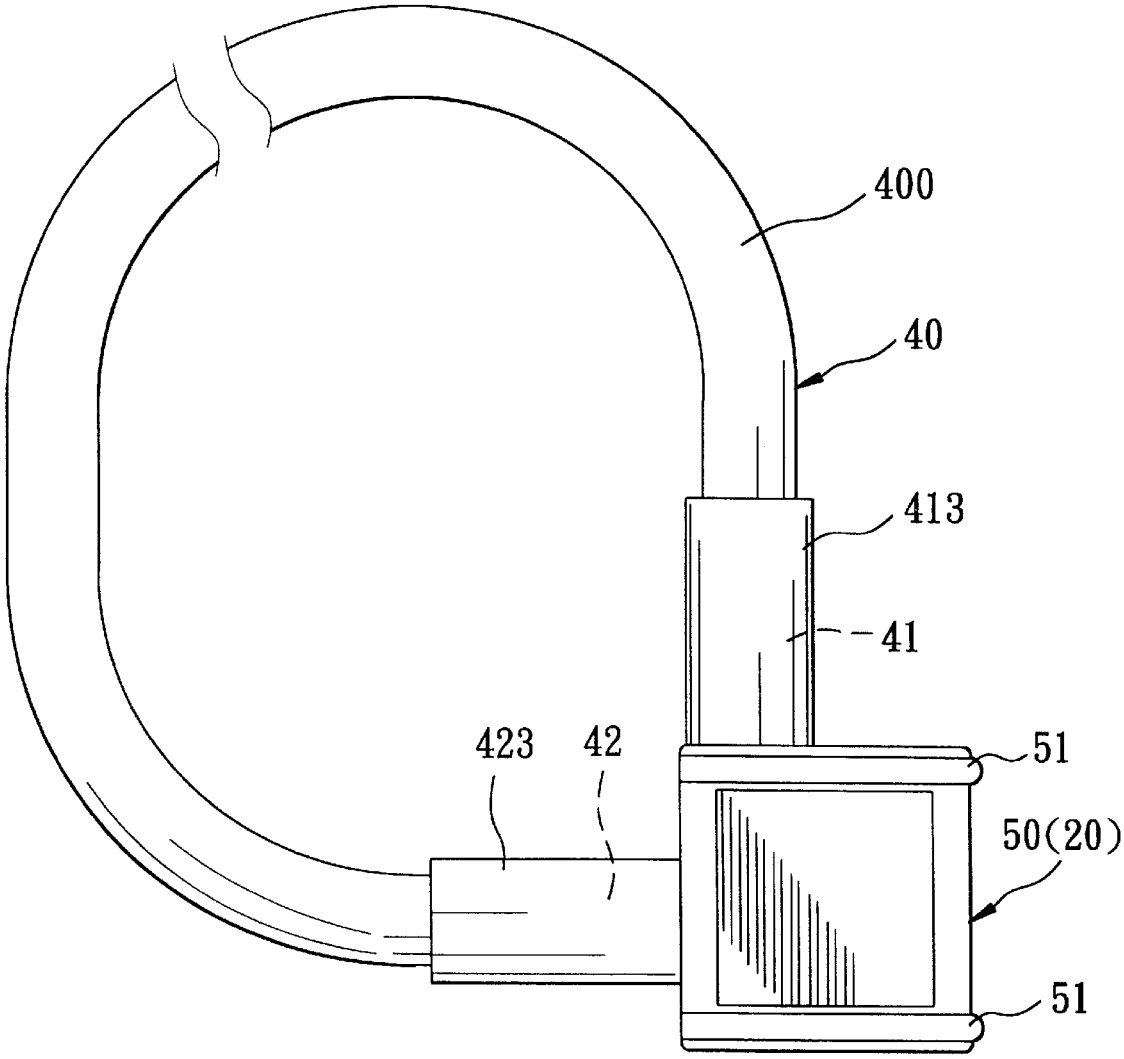
FIG. 4 is a plan view of the preferred embodiment.
Figure 5:
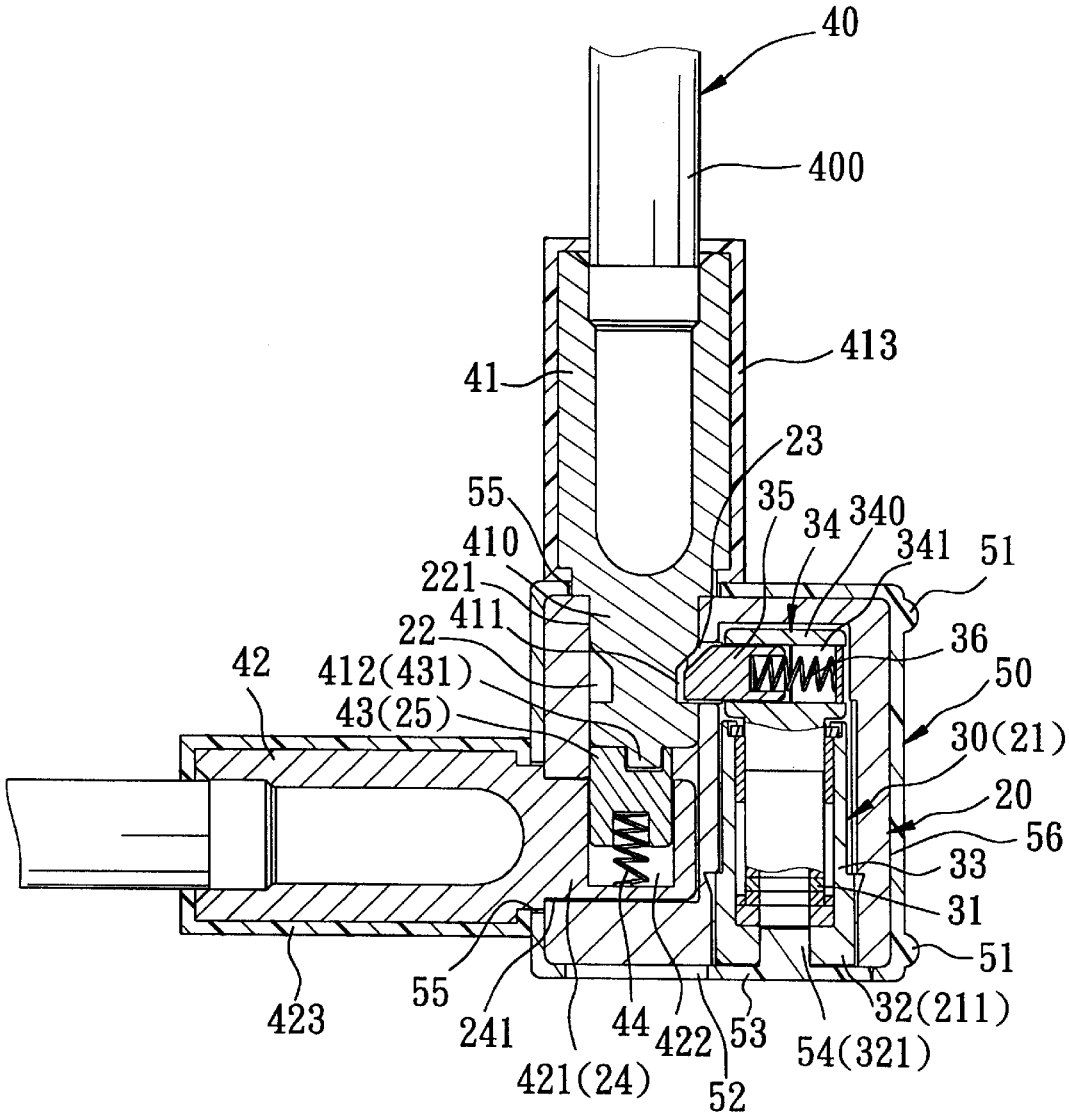
FIG. 5 is a fragmentary sectional view of the preferred embodiment in a locking state.

Referring to FIGS. 3, 4 and 5, the preferred embodiment of the shackle lock of the present invention is shown to include a lock casing 20, a lock core 30, and a shackle unit 40.

The lock casing 20 comprises front and rear casing parts 27, 26 that are fixed to each other by welding. The lock casing 20 has a lock core chamber 21 with a circular cross-section, and a rectangular lock core opening 211 for access to the lock core chamber 21. The lock core opening 211 is formed in a bottom wall of the lock casing 20, and is aligned with the lock core chamber 21 in a first direction. The lock casing 20 is further formed with a first shackle chamber 22, and a circular first shackle hole 221 for access to the first shackle chamber 22. The first shackle hole 221 is formed in a top wall of the lock casing 20, and is aligned with the first shackle chamber 22 in a second direction parallel to the first direction. The lock casing 20 is further formed with a second shackle chamber 24 and a rectangular second shackle hole 241 for access to the second shackle chamber 24 The rectangular second shackle hole 241 is formed in a left side wall of the lock casing 20, and is aligned with the second shackle chamber 24 in a third direction transverse to the second direction. A first channel 23 extends in a fourth direction transverse to the first and second directions for communicating the lock core chamber 21 and the first shackle chamber 22. A second channel 25 extends in the second direction for communicating the first and second shackle chambers 22, 24. The front casing part 27 has an inner wall surface formed with a recess 272 in an upper chamber portion of the lock core chamber 21 proximate to the top wall of the lock casing 20.

The lock core 30 is inserted into the lock core chamber 21 via the lock core opening 211. The lock core 30 has a rectangular head portion 32 which is disposed fittingly in the lock core opening 211 and which is formed with a keyhole 321 exposed from the lock core opening 211, a cylindrical body 33 disposed in a lower chamber portion of the lock core chamber 21, and a latch member 34 connected to one end of the cylindrical body 33 and disposed in the upper chamber portion. The cylindrical body 33 contains a plurality of coded disks 31 therein. The lock core 30 is operable by a corresponding key inserted into the keyhole 321 for rotating the latch member 34 between locking and unlocking positions. The latch member 34 includes a latch base 340 formed with a cavity 341 which opens in a direction transverse to an axis of the lock core 30, a latch body 35 mounted on the latch base 340 and extending into the cavity 341, and a compression spring 36 disposed in the cavity 341 for biasing the latch body 35 to extend out of the cavity 341. When the latch member 34 is in the locking position, the latch body 35 extends through the first channel 23 and projects into the first shackle chamber 22. At this time, the latch body 35 engages the first channel 23 to prevent movement of the lock core 30 in the first direction, thereby preventing removal of the lock core 30 from the lock casing 20. When the latch member 34 is in the unlocking position, the latch body 35 is rotated with the latch base 340 to move into the lock core chamber 21 and extend into the recess 272, and ceases to project into the first shackle chamber 22.

The shackle unit 40 includes first and second shackle connecting members 41, 42, which are rigid, and a flexible elongated shackle portion 400 with two opposite ends connected respectively to the first and second shackle connecting members 41, 42. The first shackle connecting member 41 is cylindrical in shape, and has an insert end portion 410 with a reduced diameter and formed with an annular locking groove 411. The insert end portion 410 is extendible into the first shackle chamber 22 via the first shackle hole 221. The locking groove 411 engages the latch body 35 when the latch member 34 is rotated to the locking position, thereby preventing removal of the first shackle connecting member 41 from the lock casing 20. The locking groove 411 is disengaged from the latch body 35 when the latch member 34 is rotated to the unlocking position, thereby permitting removal of the first shackle connecting member 41 from the lock casing 20. The insert end portion 410 has a distal end face formed with a stud 412. A first shackle protective sleeve 413, which is made of plastic in the present embodiment, is sleeved on a shackle connecting end portion of the first shackle connecting member 41 opposite to the insert end portion 410.

The second shackle connecting member 42 has a rectangular insert end portion 421 which is extendible into the second shackle chamber 24 via the second shackle hole 241. The insert end portion 421 is formed with a slot 422 which opens in a direction transverse to an axis of the second shackle connecting member 42. The insert end portion 421 is provided with a spring-loaded retaining member that includes a retaining block 43 mounted on the insert end portion 421 and extending into the slot 422, and a compression spring 44 received in the slot 422 for biasing the retaining block 43 to project from the slot 422. When the second shackle connecting member 42 is inserted into the second shackle hole 241, the retaining block 43 extends into the second channel 25, due to biasing action of the compression spring 44, and engages the lock casing 20 to prevent movement of the second shackle connecting member 42 in the third direction, thereby preventing removal of the second shackle connecting member 42 from the lock casing 20. The retaining block 43 is formed with a groove 431 for engaging the stud 412 on the first shackle connecting member 41 to help position the insert end portion 421 of the second shackle connecting member 42 in the second shackle chamber 24. A second shackle protective sleeve 423, which is made of plastic in the present embodiment, is sleeved on a shackle connecting end portion of the second shackle connecting member 42 opposite to the insert end portion 421.

Figure 6:
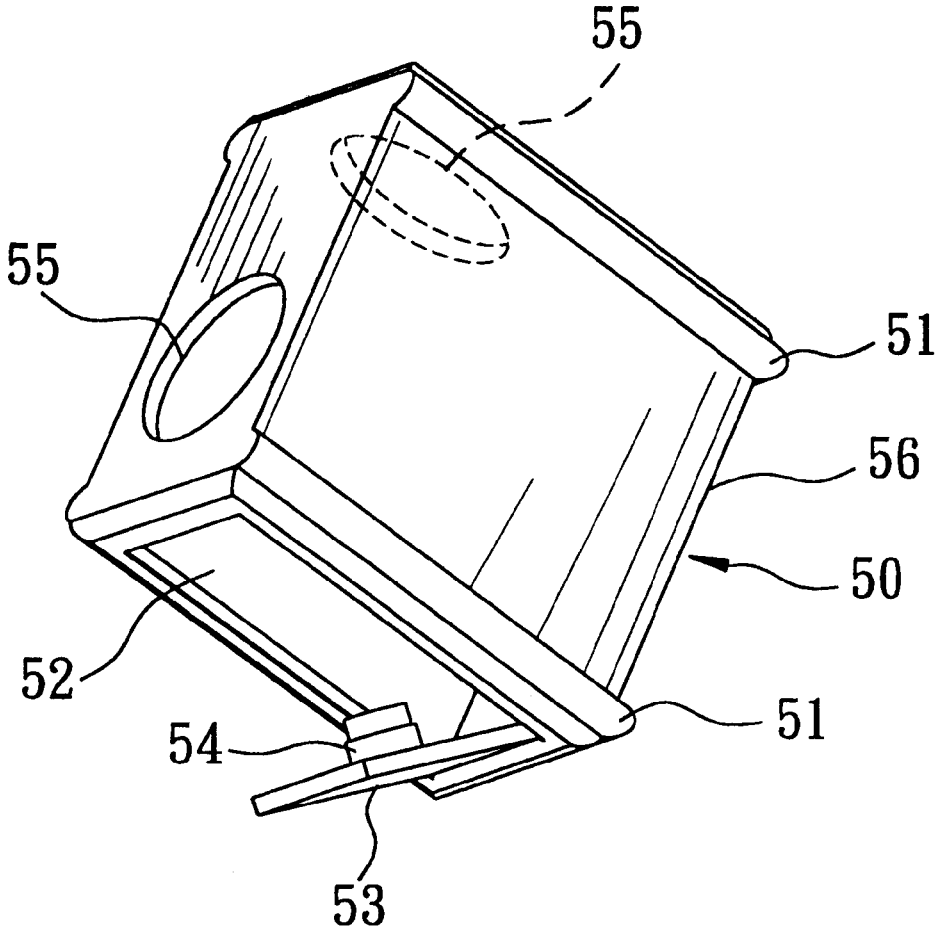
FIG. 6 is a perspective view of the protective sleeve.

Referring to FIGS. 4 to 6, the lock casing 20 has a lock protective sleeve 50 sleeved thereon. The lock protective sleeve 50 has a sleeve body 56 which is sleeved on the lock casing 20 and which has an open end 52 that permits insertion of the lock casing 20 thereinto such that the lock core opening 211 is disposed in the open end 52. The lock protective sleeve 50 further has a cover flap 53 hinged to the sleeve body 56 at the open end 52. The cover flap 53 is pivotable toward the lock core opening 211 for covering the same, and away from the lock core opening 211 to permit access to the lock core opening 211. The cover flap 53 is formed with a plug 54 which extends into the keyhole 321 when the cover flap 53 covers the lock core opening 211 so as to retain the cover flap 53 releasably in a closed state and to prevent entry of dust and moisture into the keyhole 321. The protective sleeve 50 is formed with two circular access openings 55 aligned respectively with the first and second shackle holes 221, 241 in the lock casing 20 to permit extension of the first and second shackle connecting members 41, 42 therethrough. The sleeve body 56 has an outer surface formed with two bumper strips 51. The first and second shackle protective sleeves 413, 423 on the first and second shackle connecting members 41, 42 are disposed externally of the lock casing 20 and abut against an outer surface of the lock protective sleeve 50, when the first and second shackle connecting members 41, 42 are inserted respectively into the first and second shackle holes 221, 241, to prevent entry of dust or dirty water into an interior of the lock casing 20.

Figure 7:
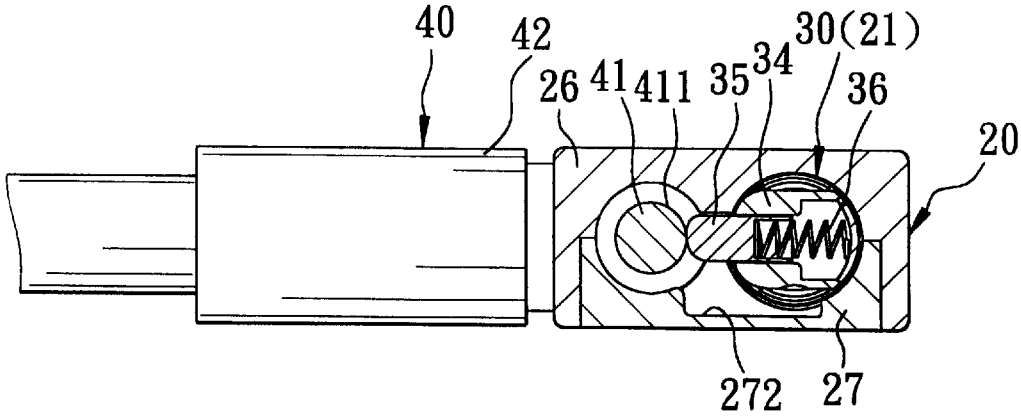
FIG. 7 is fragmentary sectional view of the preferred embodiment with the lock core illustrated in the locking state, and with a lock protective sleeve and a shackle protective sleeve removed for the sake of clarity.

Referring to FIGS. 5 and 7, in use, the second shackle connecting member 42 is inserted into the second shackle hole 241 for engaging the lock casing 20. After extending through an article to be locked, the first shackle connecting member 41 is inserted into the first shackle hole 221, thereby enabling the latch body 35 on the lock core 30 to extend into the locking groove 411 for engaging resiliently the first shackle connecting member 41.

Figure 8:
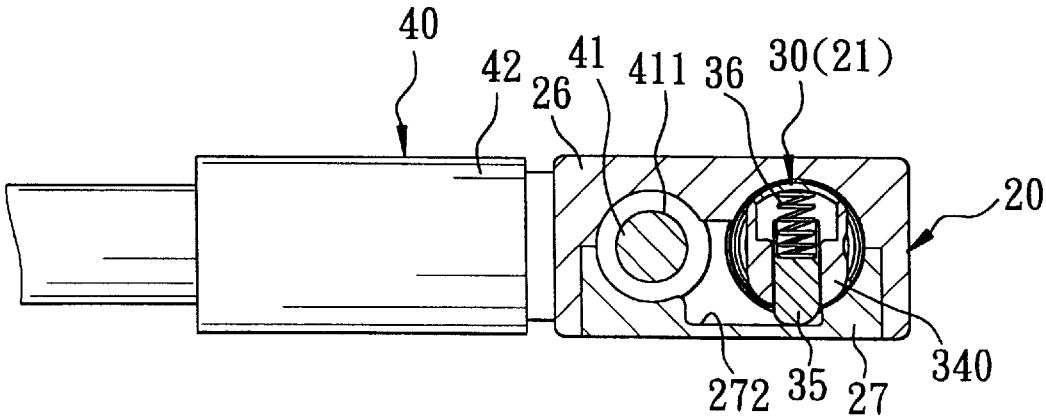
FIG. 8 is a fragmentary sectional view of the preferred embodiment similar to FIG. 7, but with the lock core illustrated in the unlocking state.
Figure 9:
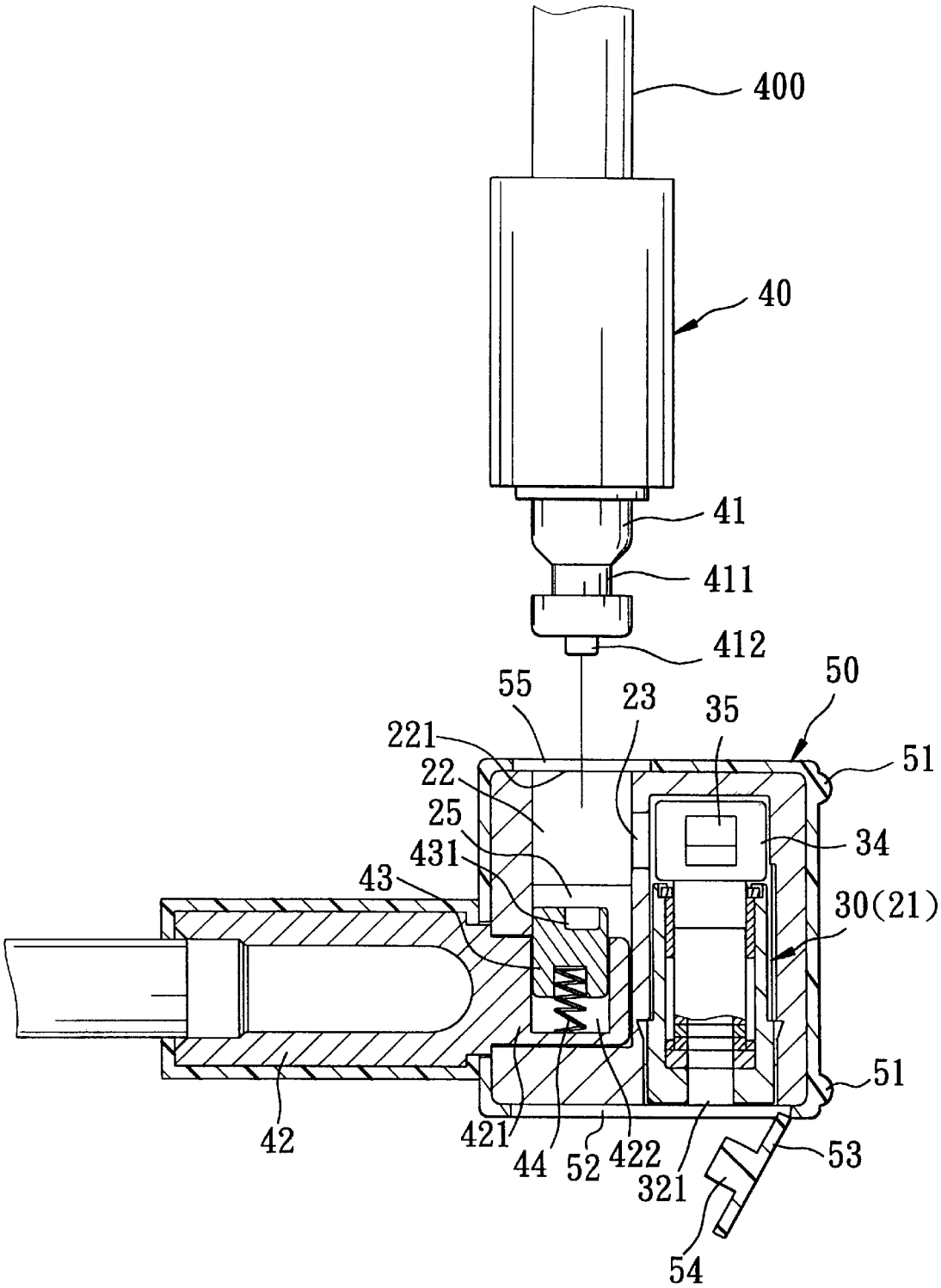
FIG. 9 is a fragmentary sectional view of the preferred embodiment, with a first shackle connecting member removed from a lock casing of the shackle lock.

Referring to FIGS. 8 and 9, to unlock the shackle lock, the corresponding key (not shown) is inserted into the keyhole 321 and is operated to turn the latch body 35 with the latch base 340 for moving the latch body 35 into the lock core chamber 21 so as to engage the recess 272 and to disengage the locking groove 411. The first shackle connecting member 41 is thus removable from the lock casing 20 via the first shackle hole 221.

Figure 10:
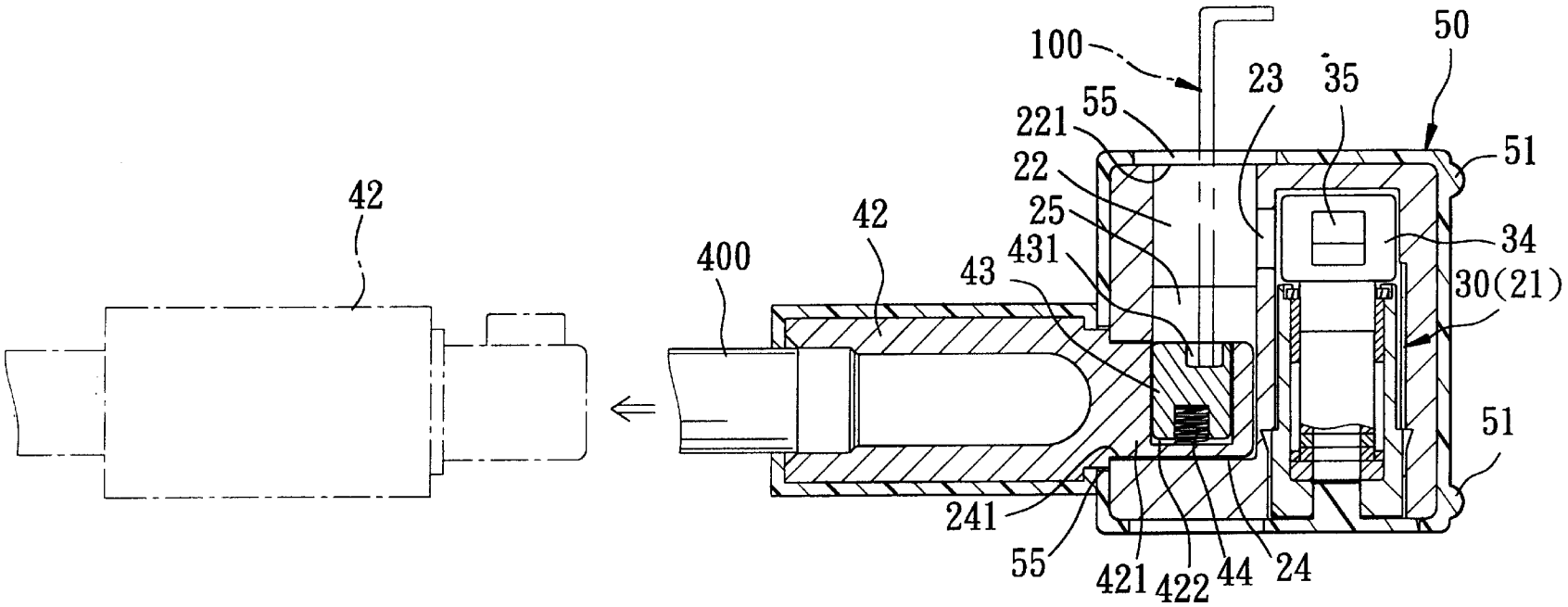
FIG. 10 is a fragmentary sectional view of the preferred embodiment, illustrating how a second shackle connecting member is removed from the lock casing.

Referring to FIGS. 9 and 10, in case the length of the flexible shackle portion 400 is not sufficient to extend through the article so as to lock the article, the shackle unit 40 can be replaced with one having a longer length, without the need for replacing the entire shackle lock. Replacement of the shackle unit 40 is conducted as follows: The lock core 30 is operated to rotate the latch member 34 to the unlocking position, and the first shackle connecting member 41 is removed from the first shackle hole 221. A tool 100 is inserted into the first shackle hole 221 to depress the retaining block 43 for retracting the retaining block 43 into the slot 422 in the insert end portion 421 of the second shackle connecting member 42. The retaining block 43 is thus disengaged from the lock casing 20 to permit removal of the second shackle connecting member 42 from the second shackle hole 241, thereby permitting separation of the entire shackle unit 40 from the lock casing 20. Thereafter, the second shackle connecting member of another shackle unit with a longer shackle portion is inserted into the second shackle hole 241 for engaging the lock casing 20, thus completing the replacement operation.

Figure 11:
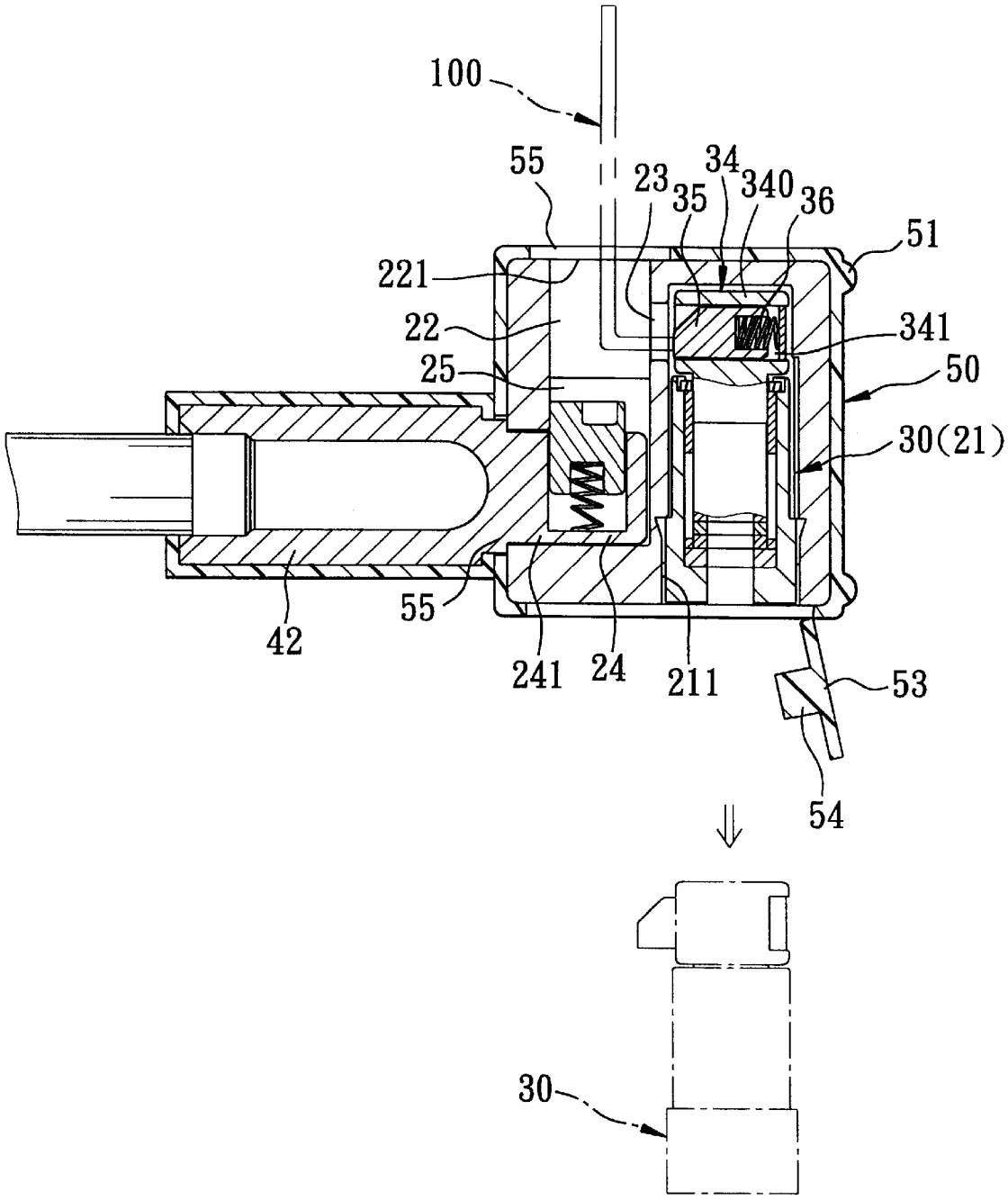
FIG. 11 is a fragmentary sectional view of the preferred embodiment, illustrating how a lock core is removed from the lock casing.

Referring to FIGS. 9 and 11, when the lock core 30 is damaged or disabled, such as due to corrosion, the lock core 30 can be replaced in the following manner: The lock core 30 is operated to move the latch member 34 to the unlocking position, and the first shackle connecting member 41 is removed from the first shackle hole 221. The tool 100 is inserted into the first shackle hole 221 to depress the latch body 35 for retracting the latch body 35 into the cavity 341 in the latch base 340 of the latch member 34. The latch member 34 is thus disengaged from the lock casing 20 to permit removal of the lock core 30 from the lock casing 20 via the lock core opening 211. After removal of the lock core 30, a new lock core is inserted into the lock core chamber 21 via the lock core opening 211 to permit the latch member on the new lock core to extend into the first channel 23 for engaging the lock casing 20, thus completing the replacement operation.

It has been shown that the lock casing 20 can be assembled selectively with shackle units 40 of different lengths, depending on the size and shape of the article to be locked. The replacement operation can be conducted easily and quickly by the user. Moreover, when the lock core 30 is damaged, the lock core 30 can be replaced without the need to replace the entire shackle lock.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A shackle lock comprising:

a lock casing having a lock core chamber, a lock core opening for access to said lock core chamber and aligned with said lock core chamber in a first direction, a first shackle chamber, a first shackle hole for access to said first shackle chamber and aligned with said first shackle chamber in a second direction parallel to the first direction, a second shackle chamber, a second shackle hole for access to said second shackle chamber and aligned with said second shackle chamber in a third direction transverse to the second direction a first channel extending in a fourth direction transverse to said first and second directions for communicating said lock core chamber and said first shackle chamber, and a second channel extending in the second direction for communicating said first shackle chamber and said second shackle chamber;

a lock core received in said lock core chamber and having a latch member, said lock core being operable for moving said latch member between a locking position in which said latch member extends through said first channel and projects into said first shackle chamber, and an unlocking position, in which said latch member is moved out of said first shackle chamber; and a shackle unit including first and second shackle connecting members and a flexible elongated shackle portion with two opposite ends connected respectively to said first and second shackle connecting members, said first shackle connecting member being extendible into said first shackle chamber via said first shackle hole and being formed with a locking groove for engaging said latch member when said latch member is moved to the locking position, said second shackle connecting member being provided with a spring-loaded retaining member and being extendible into said second shackle chamber via said second shackle hole to enable said retaining member to extend into said second channel for engaging said lock casing so as to retain said second shackle connecting member on said lock casing, said locking groove in said first shackle connecting member being disengaged from said latch member when said latch member is moved to the unlocking position, thereby permitting removal of said first shackle connecting member from said first shackle hole, said retaining member on said second shackle connecting member being accessible by means of a tool which is inserted into said first shackle hole when said first shackle connecting member is removed from said first shackle hole and being adapted to be actuated by the tool for disengaging from said lock casing in order to permit removal of said second shackle connecting member from said lock casing via said second shackle hole;

wherein said second shackle connecting member of said shackle unit is formed with a slot, said retaining member including a retaining block extending into said slot and a biasing spring received in said slot for biasing said retaining block to extend out of said slot and into said second channel so as to engage said lock casing, said retaining block being adapted to be depressed by the tool for retracting into said slot so as to permit removal of said second shackle connecting member from said second shackle hole.

2. The shackle lock as claimed in claim 1, wherein each of said first and second shackle connecting members is provided with a protective sleeve which is disposed externally of said lock casing.

3. The shackle lock as claimed in claim 1, further comprising a resilient protective sleeve which includes:

a sleeve body sleeved on said lock casing, said sleeve body having an open end that permits insertion of said lock casing thereinto, and two access openings aligned respectively with said first and second shackle holes in said lock casing to permit extension of said first and second shackle connecting members of said shackle unit therethrough; and a cover flap hinged to said sleeve body at said open end, said cover flap being pivotable toward said lock core opening in said lock casing for covering the same, and away from said lock core opening to permit access to said lock core opening.

4. The shackle lock as claimed in claim 3, wherein said lock core is formed with a keyhole adapted to permit extension of a key thereinto for operating said lock core, said cover flap being formed with a plug which is inserted into said keyhole when said cover flap covers said lock core opening.

5. The shackle lock as claimed in claim 3, wherein said sleeve body is formed integrally with said cover flap from a resilient material.

6. The shackle lock as claimed in claim 3, wherein said sleeve body has an outer surface formed with at least one bumper strip.

7. A shackle lock comprising:

a lock casing having a lock core chamber, a lock core opening for access to said lock core chamber and aligned with said lock core chamber in a first direction, a first shackle chamber, a first shackle hole for access to said first shackle chamber and aligned with said first shackle chamber in a second direction parallel to the first direction, a second shackle chamber, a second shackle hole for access to said second shackle chamber and aligned with said second shackle chamber in a third direction transverse to the second direction, a first channel extending in a fourth direction transverse to said first and second directions for communicating said lock core chamber and said first shackle chamber, and a second channel extending in the second direction for communicating said first shackle chamber and said second shackle chamber;

a lock core received in said lock core chamber and having a latch member, said lock core being operable for moving said latch member between a locking position in which said latch member extends through said first channel and projects into said first shackle chamber, and an unlocking position, in which said latch member is moved out of said first shackle chamber; and a shackle unit including first and second shackle connecting members and a flexible elongated shackle portion with two opposite ends connected respectively to said first and second shackle connecting members, said first shackle connecting member being extendible into said first shackle chamber via said first shackle hole and being formed with a locking groove for engaging said latch member when said latch member is moved to the locking position, said second shackle connecting member being provided with a spring-loaded retaining member and being extendible into said second shackle chamber via said second shackle hole to enable said retaining member to extend into said second channel for engaging said lock casing so as to retain said second shackle connecting member on said lock casing, said locking groove in said first shackle connecting member being disengaged from said latch member when said latch member is moved to the unlocking position, thereby permitting removal of said first shackle connecting member from said first shackle hole, said retaining member on said second shackle connecting member being accessible by means of a tool which is inserted into said first shackle hole when said first shackle connecting member is removed from said first shackle hole and being adapted to be actuated by the tool for disengaging from said lock casing in order to permit removal of said second shackle connecting member from said lock casing via said second shackle hole;

wherein said latch member on said lock core is accessible by means of another tool that is inserted into said first shackle hole, and is adapted to be actuated by said another tool for retracting into said lock core chamber, said latch member having a size sufficient to permit removal of said lock core from said lock core opening when said latch member is retracted;

wherein said latch member includes a latch base which is rotatable when said lock core is operated and which is formed with a cavity, a latch body mounted on said latch base and extending into said cavity and a biasing spring received in said cavity for biasing said latch body to extend out of said cavity and to project from said latch base for engaging said lock casing, said latch body being adapted to be depressed by said another tool against biasing action of said biasing spring for retracting into said cavity to permit removal of said lock core from said lock casing.

8. A shackle lock comprising:

a lock casing having a lock core chamber, a lock core opening for access to said lock core chamber and aligned with said lock core chamber in a first direction, a first shackle chamber, a first shackle hole for access to said first shackle chamber and aligned with said first shackle chamber in a second direction parallel to the first direction, a second shackle chamber, a second shackle hole for access to said second shackle chamber and aligned with said second shackle chamber in a third direction transverse to the second direction, a first channel extending in a fourth direction transverse to said first and second directions for communicating said lock core chamber and said first shackle chamber, and a second channel extending in the second direction for communicating said first shackle chamber and said second shackle chamber; a lock core received in said lock core chamber and having a latch member, said lock core being operable for moving said latch member between a locking position in which said latch member extends through said first channel and projects into said first shackle chamber, and an unlocking position, in which said latch member is moved out of said first shackle chamber; and a shackle unit including first and second shackle connecting members and a flexible elongated shackle portion with two opposite ends connected respectively to said first and second shackle connecting members, said first shackle connecting member being extendable into said first shackle chamber via said first shackle hole and being formed with a locking groove for engaging said latch member when said latch member is moved to the locking position, said second shackle connecting member being provided with a spring-loaded retaining member and being extendible into said second shackle chamber via said second shackle hole to enable said retaining member to extend into said second channel for engaging said lock casing so as to retain said second shackle connection member on said lock casing, said locking groove in said first shackle connecting member being disengaged from said latch member when said latch member is moved to the unlocking position, thereby permitting removal of said first shackle connecting member from said first shackle hole, said retaining member on said second shackle connecting member being accessible by means of a tool which is inserted into said first shackle hole when said first shackle connecting member is removed from said first shackle hole and being adapted to be acutated by the tool for disengaging from said lock casing in order to permit removal of said second shackle connecting member from said lock casing via said second shackle hole;

wherein said first shackle connecting member of said shackle unit is formed with a stud, and said retaining member on said second shackle connecting member is formed with a reciss for receiving said stud when said first shackle connecting member is inserted into said first shackle chamber via said first shackle hole.

* * * * *